US006773313B2

(12) United States Patent
Pedrinelli et al.

(10) Patent No.: US 6,773,313 B2
(45) Date of Patent: Aug. 10, 2004

(54) CONNECTING SPRING AND JUNCTION BLOCK EMPLOYING SUCH A SPRING

(75) Inventors: Pascal Pedrinelli, Anse (FR); Michel Sartorio, Chassieu (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/971,919

(22) Filed: Oct. 9, 2001

(65) Prior Publication Data

US 2003/0057621 A1 Mar. 27, 2003

(30) Foreign Application Priority Data

Oct. 10, 2000 (FR) ..... 00 12949

(51) Int. Cl.[7] ..... H01R 4/48
(52) U.S. Cl. ..... 439/828; 439/835
(58) Field of Search ..... 439/828, 789, 439/786, 417, 834, 409, 406, 434, 395, 436, 835, 437, 438, 440, 441

(56) References Cited

U.S. PATENT DOCUMENTS 4,026,013 A 5/1977 Hughes
5,679,021 A * 10/1997 Kramer ..... 439/835
5,816,867 A * 10/1998 Davidsz et al. ..... 439/828
5,860,837 A * 1/1999 Bock et al. ..... 439/828
6,126,494 A * 10/2000 Fuchs et al. ..... 439/835
6,183,288 B1 * 2/2001 Barrat et al. ..... 439/409
6,196,883 B1 * 3/2001 Bechaz et al. ..... 439/789
6,270,383 B1 * 8/2001 Wielsch et al. ..... 439/828

FOREIGN PATENT DOCUMENTS

DE 77 28 519 U 12/1977
DE 196 46 103 C1 3/1998
FR 2 389 249 A 11/1978

* cited by examiner

*Primary Examiner*—P. Austin Bradley
*Assistant Examiner*—Edwin A. Leon
(74) *Attorney, Agent, or Firm*—Oliff & Berridge, PLC

(57) ABSTRACT

A connecting spring for a junction block of the type forming a kind of loop has a pressing branch, a manipulating branch, an elastic bow connecting the pressing branch to the manipulating branch, and a moving connecting branch extending the manipulating branch on the opposite side to the elastic bow and having connecting means for at least one electric cable. The connecting spring for a junction block also has a return branch which is connected to the pressing branch at the opposite end to the elastic bow by an elastic elbow and which is intended to collaborate with the manipulating branch.

11 Claims, 2 Drawing Sheets

CONNECTING SPRING AND JUNCTION BLOCK EMPLOYING SUCH A SPRING

BACKGROUND OF THE INVENTION

The invention relates to the field of connecting springs used in blocks known as junction blocks.

It is known practice, in order to make an electrical connection between the conducting end of an electric cable and an interconnecting part placed inside the junction block, to employ a connecting spring intended to keep the conducting end of the electric cable in contact with a conducting element in an electrical relationship with the interconnecting part.

DESCRIPTION OF THE PRIOR ART

Known junction block connecting springs generally form a kind of loop. As a preference, such connecting springs are made by bending a strip of conducting material. A spring according to the prior art comprises a branch known as the pressing branch intended, as often as not, to be in contact with a tab of the interconnecting part of the junction block. The spring further comprises a manipulating branch and an elastic bow connecting the pressing branch to the manipulating branch. The spring finally comprises a moving connecting branch extending the manipulating branch on the opposite side to the elastic bow and having means of connection for at least one electric cable and, more specifically, for the conducting end thereof. The connecting means are, as often as not, produced in the form of an opening intended to accommodate the conducting end of the cable.

A spring such as this is used by placing the pressing branch against the interconnecting part so that the connecting opening of the moving branch is, in the position of rest, retracted with respect to a passage through which the electric cable is introduced into the block which also has a passage for a tool designed to act on the manipulating branch of the spring.

Thus, when there is a desire to connect an electric cable, the end thereof is introduced into the passage of the block and the operator exerts pressure on the manipulating branch so as to move the latter closer to the pressing branch so as to bring the connecting opening to face the passage and thus allow the conducting end of the cable to pass into the opening. The operator then releases his action on the manipulating branch and the elastic bow then returns the manipulating branch and the connecting branch, which is connected to it, to the position of rest to press the conducting end of the cable against a conducting element.

Such springs are generally satisfactory in terms of their connecting function but nonetheless have the disadvantage of offering a structure which does not allow high elastic return forces to be obtained unless the dimensions of the spring, and therefore its size, are increased. Now, increasing the dimensions of the spring is an obstacle to the desired reduction in the size of the junction blocks that employ such springs.

SUMMARY OF THE INVENTION

The invention therefore sets out to overcome this drawback by proposing a new connecting spring which, for an equivalent bulk, makes it possible to obtain return forces which are higher than those of the springs according to the prior art.

Thus, the new spring, according to the invention, advantageously makes it possible to obtain either, for the same bulk, a spring which offers a higher return force or, for a given return force, a spring of smaller bulk.

In order to achieve this objective, the invention is aimed at a connecting spring for a junction block of the type forming a kind of loop and comprising:

- a pressing branch,
- a manipulating branch,
- an elastic bow connecting the pressing branch to the manipulating branch, and
- a moving connecting branch extending the manipulating branch on the opposite side to the elastic bow and having connecting means for at least one electric cable.

According to the invention, the connecting spring is one which further comprises a return branch which is connected to the pressing branch at the opposite end to the elastic bow by an elastic elbow and which is intended to collaborate with the manipulating branch.

According to another feature of the invention, the return branch has, on the opposite side to the elastic elbow, a pressing heel intended to collaborate with the manipulating branch. This advantageous arrangement of the invention makes it possible to make it easier for the end of the return branch to slide over the manipulating branch as the spring contracts.

According to another feature of the invention, when the spring is in the position of rest, the return branch is in contact with the manipulating branch.

According to yet another feature, the elastic elbow connecting the return branch to the pressing branch is preloaded.

According to yet another feature of the invention, the return branch and the elastic elbow define a stop that limits the extent to which the pressing branch and the manipulating branch can move closer together.

According to yet another feature of the invention aimed at reducing the bulk of the connecting spring, at least part of the elastic bow connecting the pressing branch to the manipulating branch lies, with respect to the plane defined by the pressing branch, on the opposite side to the manipulating branch.

BRIEF DESCRIPTION OF THE DRAWINGS

Various other features of the invention will become apparent from the description with reference to the appended drawing which sets out various nonlimiting forms of embodiment of the invention.

DESCRIPTION OF THE PREFERRED EMBODIMENTS

Figure 1:
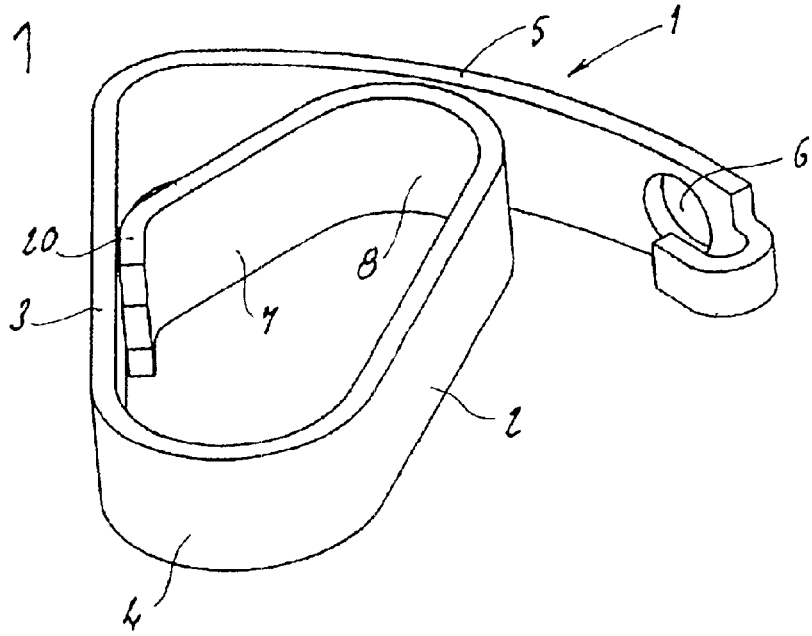
FIG. 1 is a perspective view of a preferred form of an embodiment of a spring according to the invention.
Figure 2:
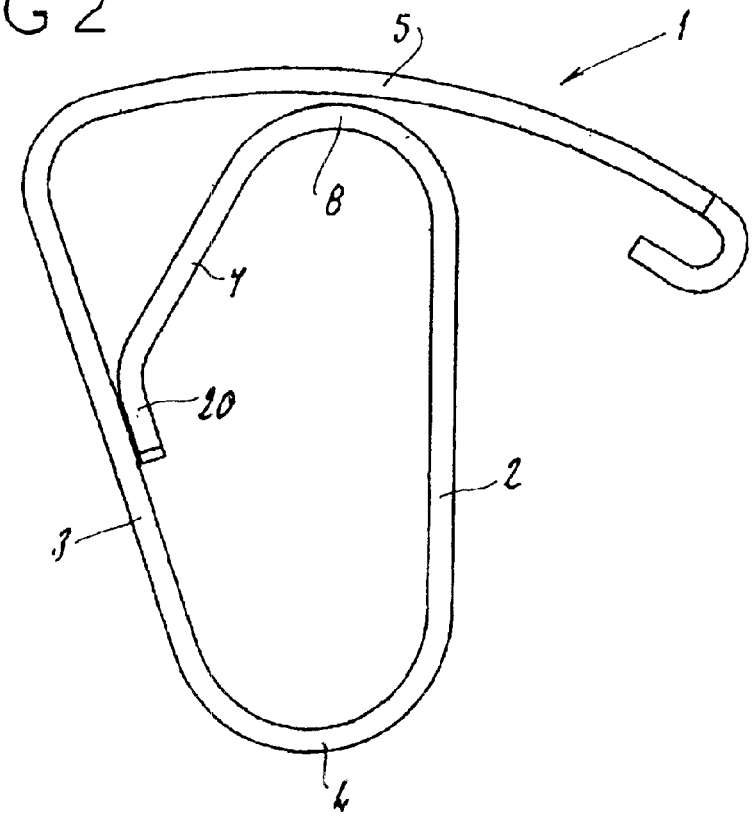
FIG. 2 is an elevation of the spring according to FIG. 1.

A connecting spring according to the invention, denoted, in its entirety, by the reference 1 in FIGS. 1 and 2 according to the invention, is in the shape of a kind of loop. This spring is preferably, although not exclusively, produced by cutting and bending a strip of conducting material which has appropriate elastic deformation properties.

The connecting spring 1 comprises a pressing branch 2, the function of which will be explained later on. The spring 1 also comprises a manipulating branch 3 which is connected to the pressing branch 2 by an elastic bow 4. According to the example illustrated, the more or less flat pressing 2 and manipulating 3 branches define, with the elastic bow 4, a kind of U.

The manipulating branch 3 is extended in the opposite direction from the elastic bow 4 by a moving branch 5 known as the connecting branch. According to the example illustrated, the connecting branch 5 is very slightly bowed and extends approximately near the opposite end of the pressing branch 2 to the elastic bow 4. It may be pointed out that the connecting branch 5 makes an acute angle with the manipulating branch 3.

The connecting branch 5 has connecting means 6 for at least one electric cable, not depicted, as will become apparent later on. The connecting means 6 are preferably, but not strictly necessarily, produced in the form of an opening made in the connecting branch 5 at one end thereof lying at the opposite end to the manipulating branch 3 and, in the example illustrated, beyond the pressing branch 2.

According to an essential feature of the invention, the connecting spring 1 further comprises a return branch 7 connected to the pressing branch 2 at the opposite end of the elastic bow 4 by an elastic elbow 8. The return branch 7 thus lies between the pressing branch 2 and the manipulating branch 3 with which the return branch 7 is intended to collaborate. As a preference, although this is not strictly necessary, the return branch 7, when the spring 1 is in the position of rest as illustrated in FIGS. 1 and 2, is in contact with the manipulating branch 3.

Figure 3:
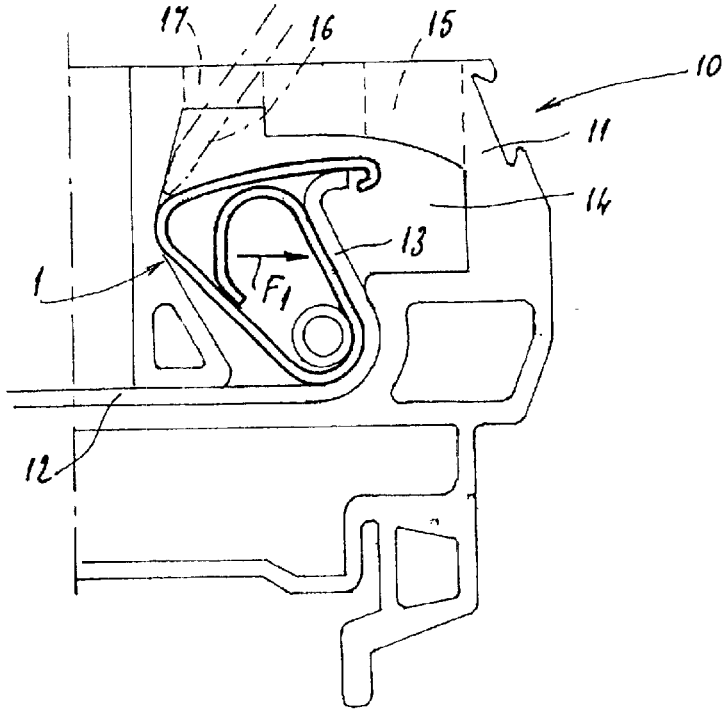
FIG. 3 is an elevation of a junction block employing a spring as illustrated in FIGS. 1 and 2.

The connecting spring 1 according to the invention thus formed may be employed in the following way in a junction block 10 as illustrated partially in FIG. 3.

The block 10 comprises a body 11 inside which there is arranged an electric interconnecting part 12 which has a tab 13 extending into a connecting chamber 14. The spring 1 is therefore arranged in the chamber 14 in such a way that the pressing branch 2 is placed against the tab 13 and that the end of the connecting branch 5 bearing the aperture 6 is, when the spring 1 is in the position of rest illustrated in solid line in FIG. 3, somewhat offset from a passage 15 formed in the body 11 of the housing for the passage of an electric cable.

To connect an electric cable to the block 10, the cable is introduced by an operator into the passage 15 while a tool 16, depicted in chain line, is introduced into a port 17 formed for that purpose in the body 11 of the housing so as to access the manipulating branch 3 of the spring 1. Using the tool 16, the operator therefore acts in the direction of the arrow F1 to move the manipulating branch 3 closer to the pressing branch 2 and to shift the connecting branch 5 in such a way as to bring the opening 6 to face the passage 15. Thus, the conducting end of the cable can be slipped into the opening 6. Upon this action on the manipulating branch 3, the elastic bow 4 is stressed. Likewise, during this movement, the manipulating branch 3 presses against the return branch 7 which therefore acts upon the elastic elbow 8. Once the conducting end of the cable has been engaged in the opening 6, the operator releases his action on the manipulating web which is then returned by the combined effects of the elastic bow 4 and of the elastic elbow 8 acting on the manipulating branch 3 via the return branch 7. This combined action makes it possible to obtain a significant return force which results from the sum of the forces generated by the elastic bow 4 and the elastic elbow 8. This significant return force therefore contributes to the firm holding of the conducting end of the cable against the tab 13.

To make it easier for the free end of the return branch 7 to slide against the manipulating branch 3, the return branch 7 preferably, although this is not strictly necessary, has a pressing heel 20. In the embodiment illustrated, the pressing heel 20 is formed by bending the free end of the return branch 7 in such a way as to offer the manipulating branch 3 a more or less smooth bearing surface free of rough edges likely to cause seizure as the manipulating branch 3 and return branch 7 rub one against the other.

In an alternative form of embodiment, the elastic elbow 8 is preloaded when the spring 1 is manufactured so as to further increase the return force available when the branch 3 is manipulated.

According to the example illustrated, when the spring 1 is in the position of rest, the return branch 7 presses against the manipulating branch 3.

However, it is not necessary for the return branch 7 to be in contact with the manipulating branch when the spring is in the position of the rest.

Figure 4:
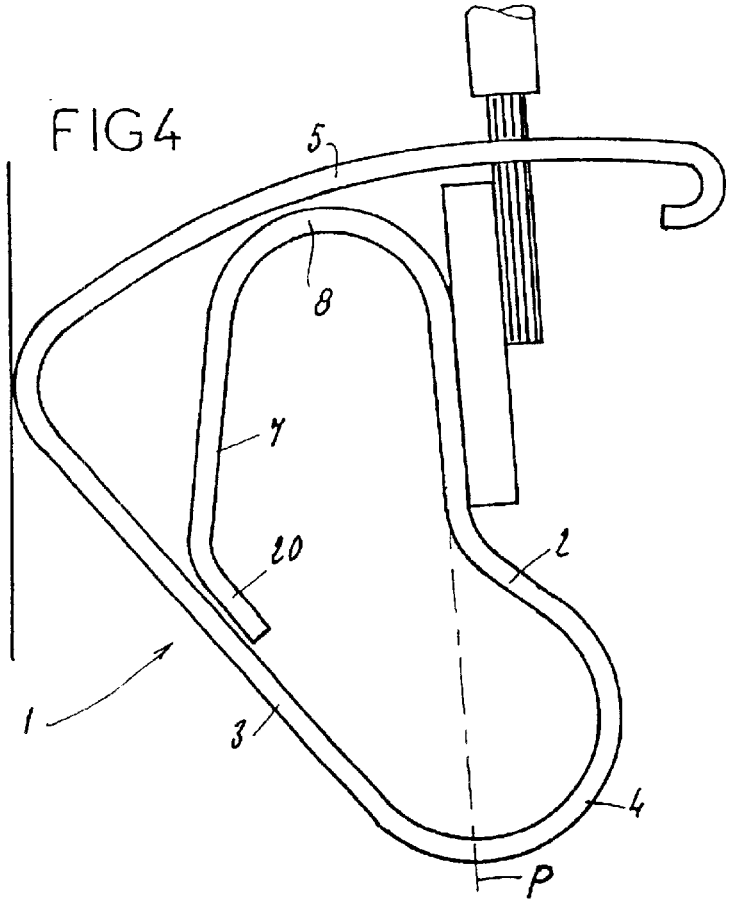
FIG. 4 is an elevation similar to FIG. 2 showing another form of embodiment of a spring according to the invention.

Thus, FIG. 4 illustrates a form of embodiment of the spring according to the invention in which the free end of the return branch 7 is not in contact with the manipulating branch 3 when the spring 1 is in the position of rest.

Furthermore, according to the embodiment illustrated in FIG. 4, in order to reduce the overall bulk of the spring 1 as far as possible, at least part of the elastic bow 4 connecting the pressing branch 2 to the manipulating branch 3 is on the opposite side to the manipulating branch 3 with respect to a plane P defined by the pressing branch.

In the above examples, the return branch 7 and the elastic elbow 8 have the main function of returning the manipulating branch 3. However, the return branch 7 and the elbow 8 may have an additional function as a stop preventing the manipulating branch 3 from being moved too close to the pressing branch 2. This is because if these two branches 2 and 3 are moved too close together, this may impair the elasticity properties of the spring or even cause the elastic bow 4 to break.

What is claimed is:

1. A connecting spring for a junction block of the type forming a kind of loop and comprising:

a pressing branch, a manipulating branch, an elastic bow connecting the pressing branch to the manipulating branch, and a moving connecting branch extending the manipulating branch on the opposite side to the elastic bow and having connecting means for at least one electric cable, wherein the pressing branch is disposed between an elastic elbow at a first end and the elastic bow at a second end opposed to the first and a return branch is disposed at an end of the elastic elbow opposite the pressing branch, and which is configured to engage with the manipulating branch.

2. The connecting spring as claimed in claim 1, wherein the return branch has, on the opposite side to the elastic elbow, a pressing heel configured to collaborate with the manipulating branch.

3. The connecting spring as claimed in claim 1, wherein the connecting branch lies near the opposite end of the pressing branch to the elastic bow.

4. The connecting spring as claimed in claim 1, wherein the connecting means of the moving branch comprise an opening for the passage of an electric cable.

5. The connecting spring as claimed in claim 1, wherein the return branch and the elastic elbow define a stop that limits the extent to which the pressing branch and the manipulating branch can move closer together.

6. The connecting spring as claimed in claim 1, wherein at least part of the elastic bow connecting the pressing branch to the manipulating branch lies, with respect to the plane defined by the pressing branch, on the opposite side to the manipulating branch.

7. The connecting spring as claimed in claim 1, which is produced by bending a strip of conducting material.

8. A connection block comprising at least one connecting spring as claimed in claim 1 in contact with an interconnecting part.

9. The connection spring according to claim 1, wherein the return branch lies between the pressing branch and the manipulating branch.

10. The connecting spring as claimed in claim 1, wherein, when the spring is in the position of rest, the return branch is in contact with the manipulating branch.

11. The connecting spring as claimed in claim 10, wherein, when the spring is in the position of rest, the elastic elbow is preloaded.

* * * * *